US006800148B2

(12) United States Patent
Frasier et al.

(10) Patent No.: US 6,800,148 B2
(45) Date of Patent: Oct. 5, 2004

(54) SINGLE CRYSTAL VANE SEGMENT AND METHOD OF MANUFACTURE

(75) Inventors: Donald J. Frasier, Greenwood, IN (US); Philip S. Burkholder, Pittsboro, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 62 days.

(21) Appl. No.: 10/373,118

(22) Filed: Feb. 24, 2003

(65) Prior Publication Data

US 2003/0150534 A1 Aug. 14, 2003

Related U.S. Application Data

(63) Continuation of application No. 09/669,496, filed on Sep. 25, 2000, now abandoned, which is a continuation of application No. 09/251,660, filed on Feb. 17, 1999, now abandoned.

(60) Provisional application No. 60/107,141, filed on Nov. 5, 1998.

(51) Int. Cl.[7] ..... F03B 3/18

(52) U.S. Cl. ..... 148/404; 148/428; 415/208.1

(58) Field of Search ..... 148/404, 427, 148/428; 415/208.1

(56) References Cited

U.S. PATENT DOCUMENTS

| | | | |
|---|---|---|---|
| 4,169,742 | A | 10/1979 | Wukusick et al. |
| 4,637,448 | A | 1/1987 | Burke et al. |
| 4,804,311 | A | 2/1989 | Anderson et al. |
| 4,908,183 | A | 3/1990 | Chin et al. |
| 5,171,380 | A | 12/1992 | Henry |
| 5,399,313 | A | 3/1995 | Ross et al. |
| 5,611,389 | A | 3/1997 | Alessandri et al. |
| 5,611,670 | A | 3/1997 | Yoshinari et al. |
| 5,673,745 | A | 10/1997 | Jackson et al. |
| 6,419,763 | B1 | 7/2002 | Konter et al. |

OTHER PUBLICATIONS

Caruel, Bourguignon, Lallement, Fargeus, DeBussac, "SNECMA Experience with Cost Effective DS Airfoil Technology Applied Using CM 186 LC® Alloy", Presented at the ASME "TURBO EXPO '96", NEC, Birmingham, UK, Jun. 10–13, 1996.

Korinko, Barber, Thomas, "Coating Characterization and Evaluation of Directionally Solidified CM 186 LC® and Single Crystal CMSX–4®", Presented at the ASME "TURBO EXPO '96", NEC, Birmingham, UK, Jun. 10–13, 1996.

McColvin, Sutton, Whitehurst, Fleck, Van Vranken, Harris, Erickson, Wahl, "Application of the Second Generation DS Superalloy CM 186 LC® to First Stage Turbine Blading in EGT Industrial Gas Turbines", Presented at the Institute of Materials, Fourth International Charles Parsons Turbine Conference, *Advances in Turbine Materials, Design and Manufacturing*, Nov. 4–6, 1997, Civic Centre, Newcastle upon Tyne, UK.

Harris, Erickson, Sikkenga, Brentnall, Aurrecoechea, Kubarych, "Development of the Rhenium Containing Superalloys CMSX–4® & CM 186 CM 186 LC® For Single Crystal Blade and Directionally Solidified Vane Applications in Advanced Turbine Engines", Presented at the Seventh International Symposium on Superalloys, Seven Springs, Sep. 20–24, 1992. Also in *Journal of Materials Engineering and Performance, ASM International*, ASM International, Materials Park, vol. 2, No. 4, Aug. 1, 1993, pp. 481–487.

(List continued on next page.)

*Primary Examiner*—George Wyszomierski
(74) *Attorney, Agent, or Firm*—Woodard, Emhardt, Moriarty, McNett & Henry LLP

(57) ABSTRACT

The present invention contemplates a multi-airfoil vane segment produced as a single crystal casting from a rhenium containing directionally solidified alloy. The single crystal casting containing grain boundary strengtheners.

36 Claims, 5 Drawing Sheets

OTHER PUBLICATIONS

Broomfield, Ford, Bhangu, Thomas, Frasier, Burkholder, Harris, Erickson, Wahl, "Development and Turbine Engine Performance of Three Advanced Rhenium Containing Superalloys for Single Crystal and Directionally Solidified Blades and Vanes", *Journal of Engineering for Gas Turbines and Power*, vol. 120, Jul. 1998, pp. 595–608.

Harris, Schwer, "Vacuum induction Refined MM 0011 (MAR M–247) for Investment Cast Turbine Components", pp. 319–339.

Mc Quigg, et al., "New Alloy Developments in Single Crystal and DS Alloys", *High Temperature Materials and Processes*, Freud Publishing House, Ltd., GB, 1993, pp. 247–254.

SINGLE CRYSTAL VANE SEGMENT AND METHOD OF MANUFACTURE

The present application is a continuation of U.S. patent application Ser. No. 09/669,496 filed Sep. 25, 2000 now abandoned. Application Ser. No. 09/669,496 is a continuation of U.S. patent application Ser. No. 09/251,660 flied Feb. 17, 1999 now abandoned. Application Ser. No. 09/251,660 claims the benefit of U.S. Provisional Patent Application Ser. No. 60/107,141 filed Nov. 5, 1998. Each of the above listed applications is incorporated herein by reference.

BACKGROUND OF THE INVENTION

The present invention relates generally to cast gas turbine engine components and their method of manufacture. More particularly, in one embodiment of the present invention, a multi-airfoil vane segment is produced as a single crystal casting from a Rhenium containing directionally solidified (DS) chemistry alloy. Although the invention was developed for gas turbine engine components, certain applications may be outside of this field.

The performance of a gas turbine engine generally increases with an increase in the operating temperature of a high temperature working fluid flowing from a combustion chamber. One factor recognized by gas turbine engine designers as limiting the allowable temperature of the working fluid is the capability of the engine components to not degrade when exposed to the high temperature working fluid. The airfoils, such as blades and vanes, within the engine are among the components exposed to significant thermal and kinetic loading during engine operation.

Many gas turbine engines utilize cast components formed of a nickel or cobalt alloy. The components can be cast as a polycrystalline, directionally solidified, or single crystal structure. Generally, the most desirable material properties are associated with the single crystal structure. However, the geometry of some components, such as the multi-airfoil vane segment, causes difficulty during the casting process largely associated with grain or crystal defects. Single crystal alloys are not tolerant to these types of defects and therefore castings, which exhibit these defects, are generally not suitable for engine use. Thus, the casting yields are lower and consequently the cost to manufacture the component increases.

A directionally solidified component has material properties between single crystal and polycrystalline and are easier to produce than single crystal components. Directionally solidified components are generally defined as multi-crystal structures with columnar grains and are generally cast from a directionally solidified alloy containing grain boundary strengtheners. The directionally solidified component is best suited for designs where the stress field is oriented along the columnar grains and the stress field transverse to the columnar grain is minimized. However, in a component, such as a multi-airfoil vane segment, the stress fields are elevated along the airfoils and in a transverse direction associated the inner and outer shrouds which tie the airfoils together.

Although the prior techniques can produce single crystal multi-airfoil vane segments, there remains a need for an improved single crystal multi-airfoil vane segment and method of manufacture. The present invention satisfies this and other needs in a novel and unobvious way.

SUMMARY OF THE INVENTION

One form of the present invention contemplates a product comprising a cast single crystal structure formed of a directionally solidified alloy.

Another form of the present invention contemplates a gas turbine engine component, comprising a single cast single crystal vane segment having a plurality of airfoils, the vane segment is formed of a directionally solidified alloy.

Yet another form of the present invention contemplates a gas turbine engine component comprising a single cast single crystal shrouded vane formed of a directionally solidified alloy.

Also, another form of the present invention contemplates a method for producing a single crystal article. The method comprising: providing a directionally solidified alloy; melting the directionally solidified alloy; pouring the molten directionally solidified alloy into a casting mold; and, solidifying the directionally solidified alloy to produce a single crystal article.

One object of the present invention is to provide a single crystal multi-airfoil vane segment and method of manufacture.

Related objects and advantages of the present invention will be apparent from the following description.

DESCRIPTION OF THE PREFERRED EMBODIMENT

Figure 1:
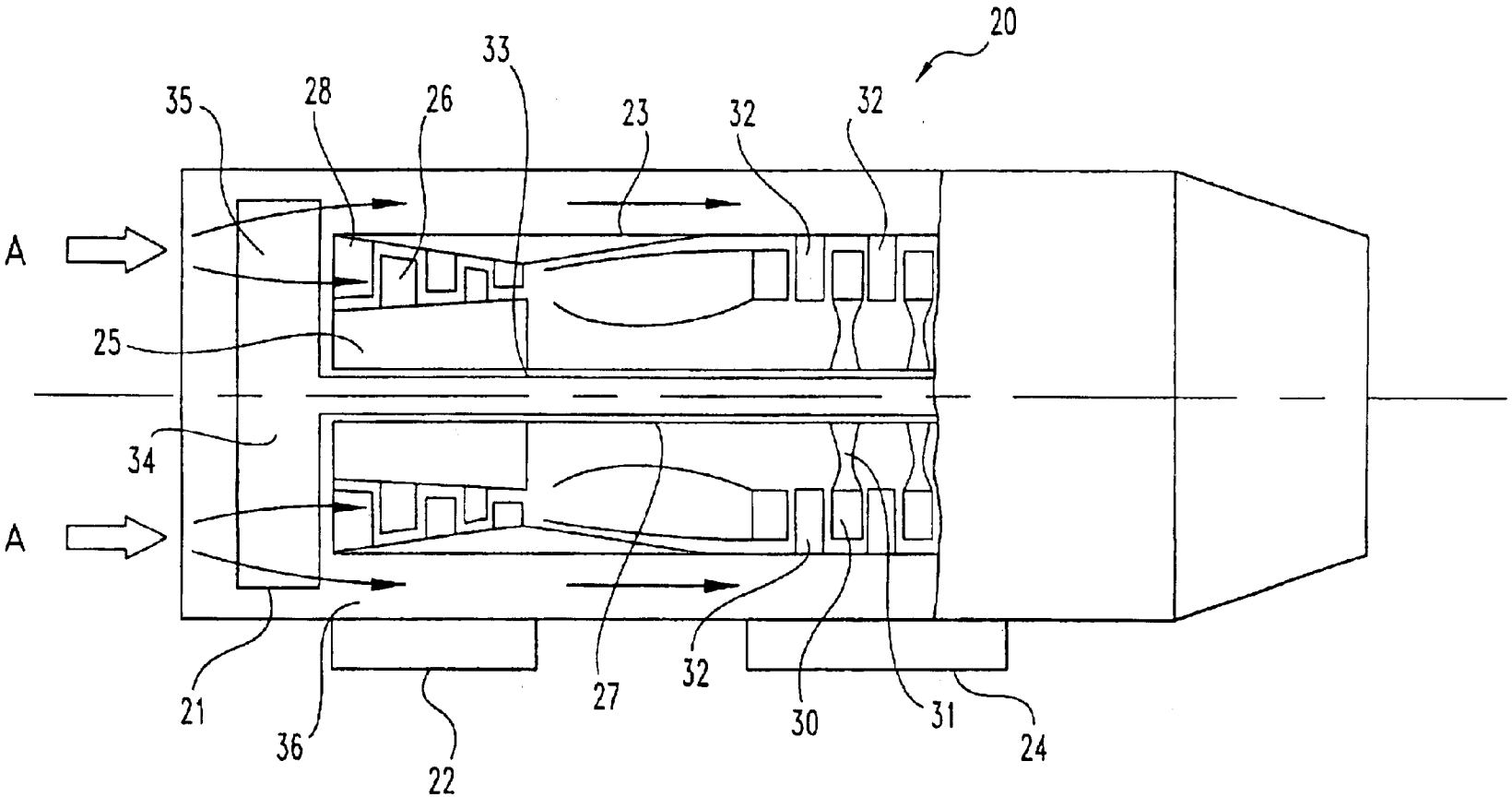
FIG. 1 is an illustrative view of a gas turbine engine.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a gas turbine engine 20 which includes a fan section 21, a compressor section 22, a combustor section 23, and a turbine section 24 that are integrated together to produce an aircraft flight propulsion engine. This type of gas turbine engine is generally referred to as a turbo-fan. One alternate form of a gas turbine engine includes a compressor, a combustor, and a turbine that have been integrated together to produce an aircraft flight propulsion engine without the fan section. The term aircraft is generic and includes helicopters, airplanes, missiles, unmanned space devices and any other substantially similar devices. It is important to realize that there are a multitude of ways in which the gas turbine engine components can be linked together. Additional compressors and turbines could be added with intercoolers connecting between the compressors and reheat combustion chambers could be added between the turbines.

A gas turbine engine is equally suited to be used for an industrial application. Historically, there has been widespread application of industrial gas turbine engines, such as pumping sets for gas and oil transmission lines, electricity generation, and naval propulsion.

The compressor section 22 includes a rotor 25 having a plurality of compressor blades 26 coupled thereto. The rotor 25 is affixed to a shaft 27 that is rotatable within the gas turbine engine 20. A plurality of compressor vanes 28 are positioned within the compressor section 22 to direct the fluid flow relative to blades 26. Turbine section 24 includes a plurality of turbine blades 30 that are coupled to a rotor disk 31. The rotor disk 31 is affixed to the shaft 27, which is rotatable within the gas turbine engine 20. Energy extracted in the turbine section 24 from the hot gas exiting the combustor section 23 is transmitted through shaft 27 to drive the compressor section 22. Further, a plurality of turbine vanes 32 are positioned within the turbine section 24 to direct the hot gaseous flow stream exiting the combustor section 23.

The turbine section 24 provides power to a fan shaft 33, which drives the fan section 21. The fan section 21 includes a fan 34 having a plurality of fan blades 35. Air enters the gas turbine engine 20 in the direction of arrows A and passes through the fan section 21 into the compressor section 22 and a bypass duct 36. Further details related to the principles and components of a conventional gas turbine engine will not be described herein as they are believed known to one of ordinary skill in the art.

Figure 2:
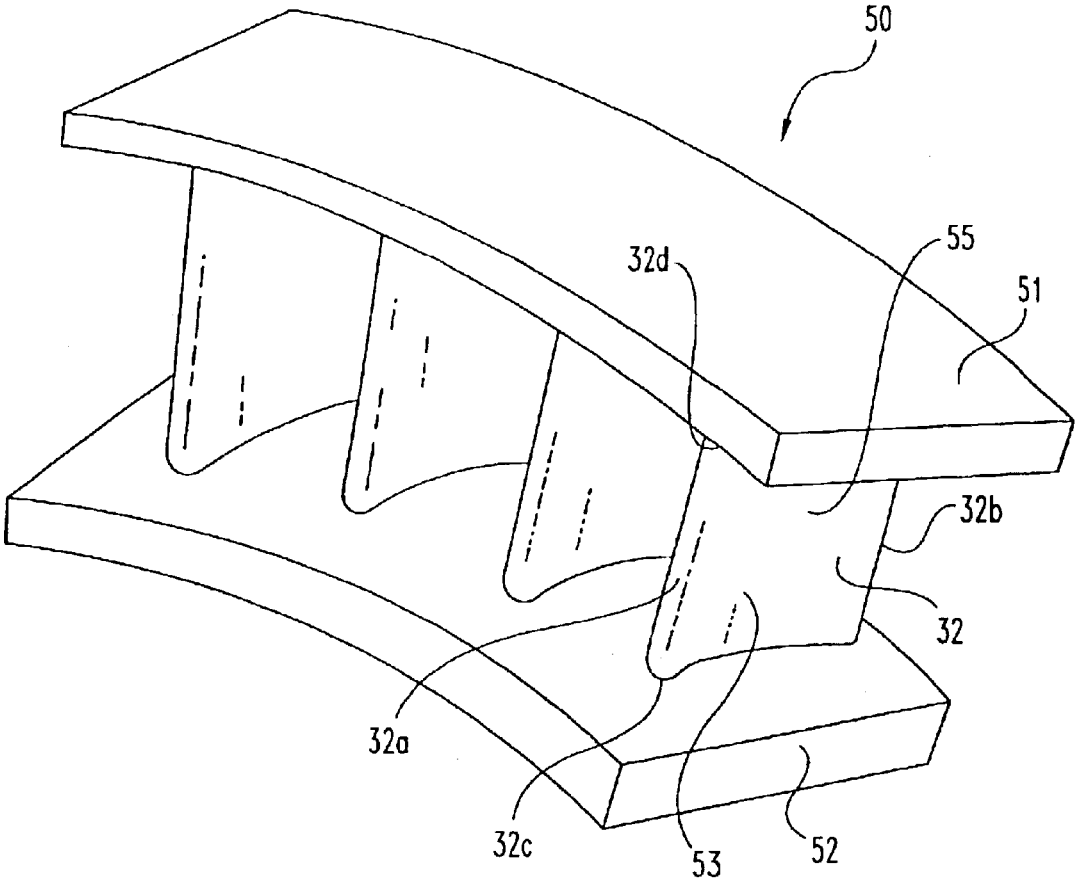
FIG. 2 is a perspective view of a multi-airfoil vane segment comprising a portion of the FIG. 1 gas turbine engine.

With reference to FIG. 2, there is illustrated a vane segment 50 which forms a portion of a turbine nozzle. A plurality of vane segments 50 are conventionally joined together to collectively form the complete 360° turbine nozzle. Each of the vane segments 50 include a plurality of vanes 32 that are coupled to end wall members 51 and 52. The embodiment of vane segment 50, illustrated in FIG. 2, has four vanes coupled thereto, however it is contemplated herein that a vane segment may have one or more vanes per vane segment and is not limited to a vane segment having four vanes. In a preferred form of the present invention the turbine nozzle includes eleven vane segments having four vanes each. However, a turbine nozzle formed from other quantities of vane segments, and vane segments having other numbers of vanes are contemplated herein.

Vane 32 has a leading edge 32*a* and a trailing edge 32*b* and an outer surface extending therebetween. The term spanwise will be used herein to indicate an orientation between the first end wall member 51 and the second end wall member 52. Further, the term streamwise will be used herein to indicate an orientation between the leading edge 32*a* and the trailing edge 32*b*. Each vane 50 defines an airfoil with the outer surface 53 extending between the leading edge 32*a* and the trailing edge 32*b*. The leading and trailing edges of the vane extend between a first end 32*c* and a second opposite other end 32*d*. The outer surface 53 of the vane 50 includes a convex suction side (not illustrated) and a concave pressure side 55.

In one embodiment, the gas turbine engine vane 32 is a hollow single-cast single crystal structure produced by single crystal casting techniques utilizing a directionally solidified alloy composition. In another embodiment, the gas turbine engine vane is a solid single-cast single crystal structure produced by single crystal casting techniques utilizing a directionally solidified alloy composition. Further, the present invention contemplates gas turbine engine vanes having internal cooling passageways and apertures for the passage of a cooling media. Cast single crystal casting techniques are believed known to those of ordinary skill in the art. One process for producing a cast single crystal structure is set forth in U.S. Pat. No. 5,295,530 to O'Connor, which is incorporated herein by reference.

Figure 3:
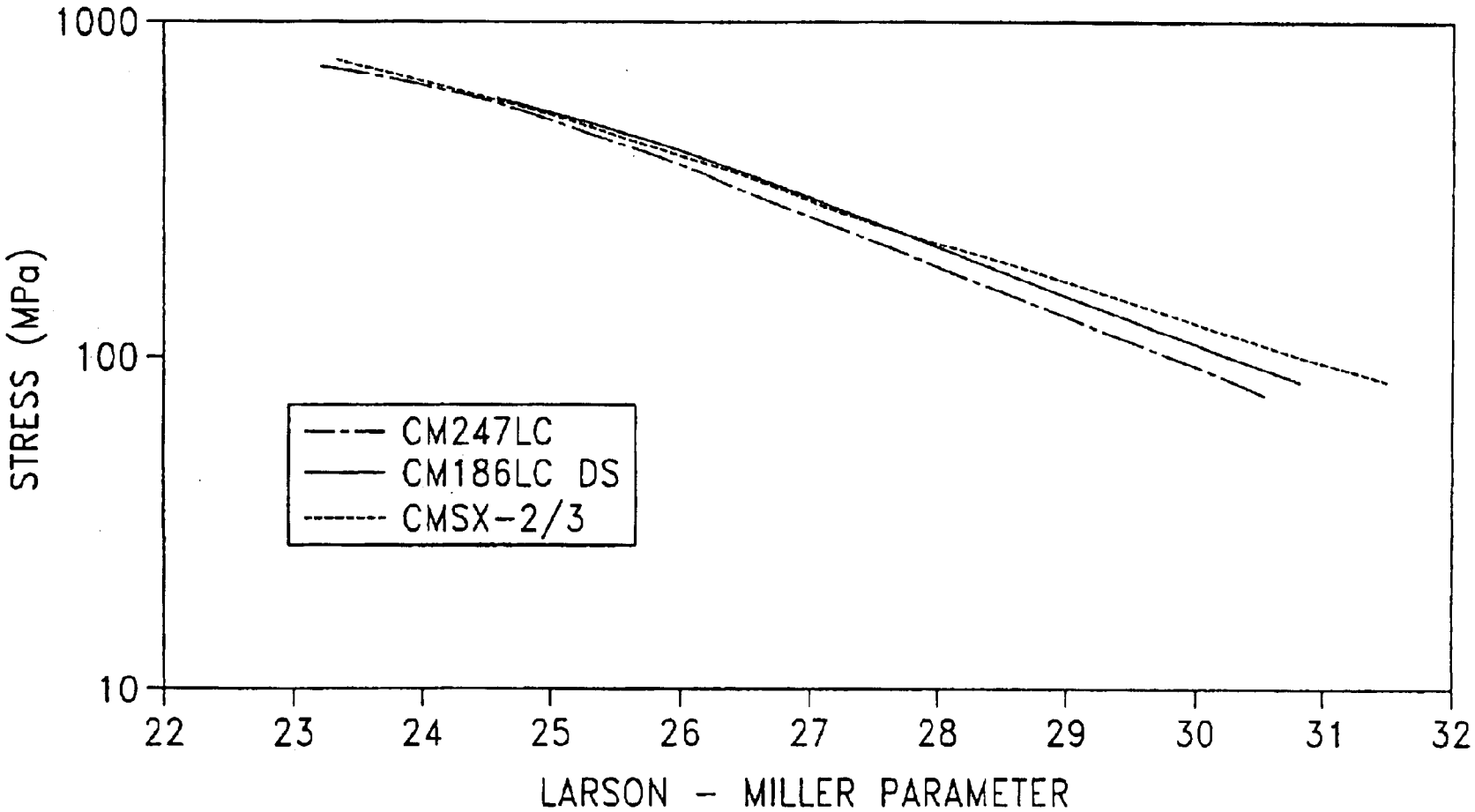
FIG. 3 is a Larson-Miller plot comparing three alloys.

In the present invention the material utilized to produce the cast single crystal structure is a directionally solidified alloy, which often is referred to as a DS alloy. More preferably, the alloy is a second-generation directionally solidified superalloy. Second-generation directionally solidified superalloys have creep rupture strengths similar to first generation single crystal superalloys, such as CMSX-2® and CMSX-3® at up to 1000 degrees centigrade. For example in FIG. 3, there is illustrated a Larson-Miller Plot showing the strength of CM186 LC in comparison to CMSX 2/3 and CM247LC. Examples of the second-generation superalloys include, but are not intended to be limited herein to: PWA 1426 (a Pratt & Whitney product); René 142 (a General Electric product); and, CM186 LC (a Cannon-Muskegon product). Other directionally solidified alloys are contemplated herein for use in producing a cast single crystal structure.

Each of the directionally solidified alloys include grain boundary strengtheners that are designed to increase grain boundary strength. The alloys PWA 1426, Rene 142 and CM186 LC each include boron, carbon, hafnium, and zirconium as their grain boundary strengtheners. Other directionally solidified alloys containing grain boundary strengtheners are contemplated herein. A grain boundary is generally defined as a region in the cast component of non-oriented structure having a width of only a few atomic diameters which serves to accommodate the crystallographic orientation difference or mismatch between adjacent grains. It will be appreciated by those skilled in the art that neither low angle grain boundaries nor high angle grain boundaries will be present in a theoretical "single crystal". However, it will be further appreciated that although there may be one or more grain boundaries present in commercial single crystal structures, they are still characterized as a single crystal structure. Further, manufacturing processes more tolerant of these crystal anomalies are inherently less expensive.

The nominal chemical composition for the Rhenium containing alloys PWA 1426, Rene 142 and CM186 LC are disclosed in Table I.

TABLE I

| | NOMINAL COMPOSITION, WEIGHT % | | | | | | | | | | | | | |
|---|---|---|---|---|---|---|---|---|---|---|---|---|---|---|
| Alloy | Cr | Co | Mo | W | Ta | Re | Al | Ti | Hf | C | B | Zr | Ni | Density (kg/dm) |
| PWA 1426 | 6.5 | 12 | 2 | 6 | 4 | 3 | 6.0 | — | 1.5 | .10 | .015 | .03 | BAL | 8.6 |
| René 142 | 6.8 | 12 | 2 | 5 | 6 | 3 | 6.2 | — | 1.5 | .12 | .015 | .02 | BAL | 8.6 |

TABLE I-continued

| | NOMINAL COMPOSITION, WEIGHT % | | | | | | | | | | | | | |
|---|---|---|---|---|---|---|---|---|---|---|---|---|---|---|
| Alloy | Cr | Co | Mo | W | Ta | Re | Al | Ti | Hf | C | B | Zr | Ni | Density (kg/dm) |
| CM 186 LC | 6.0 | 9 | .5 | 8 | 3 | 3 | 5.7 | .7 | 1.4 | .07 | .015 | .005 | BAL | 8.70 |

Figure 4:
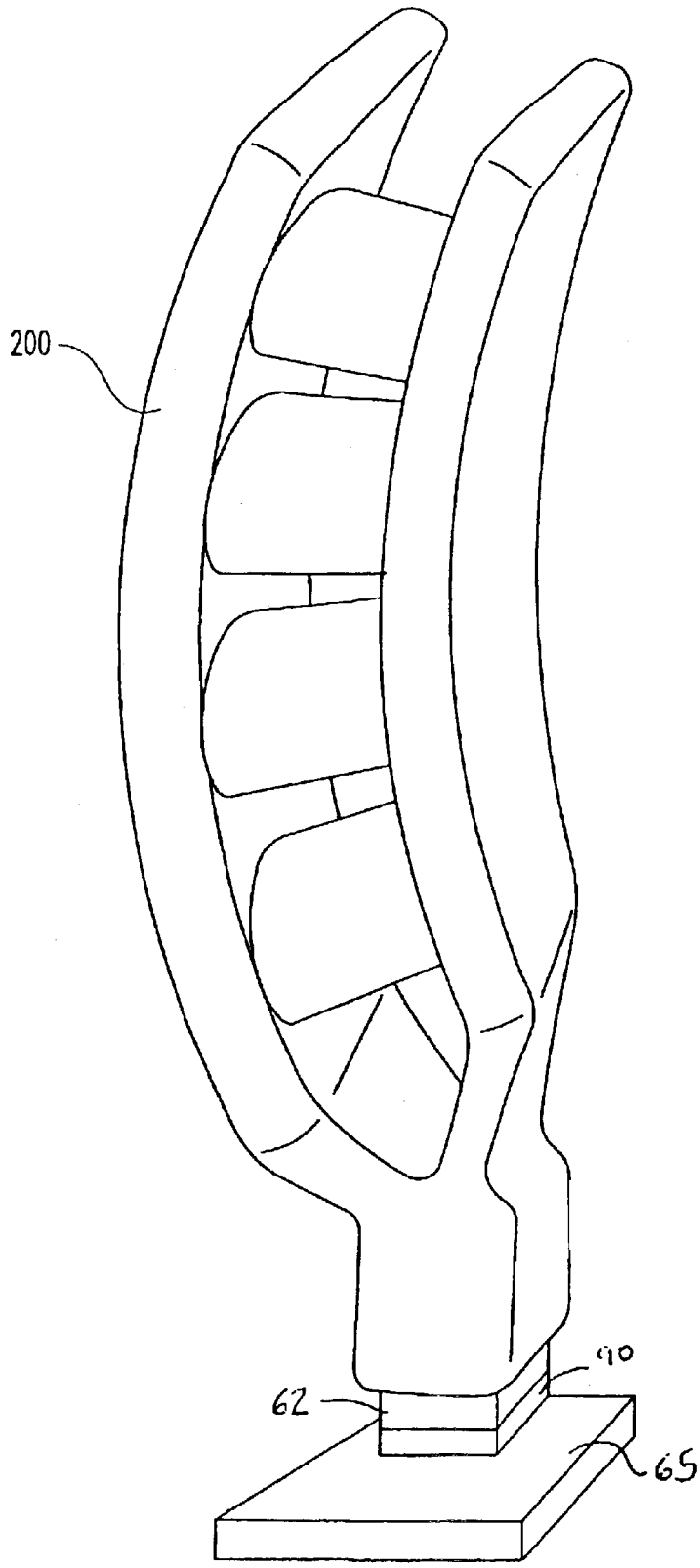
FIG. 4 is an illustrative view of a casting mold for forming a vane segment.
Figure 5:
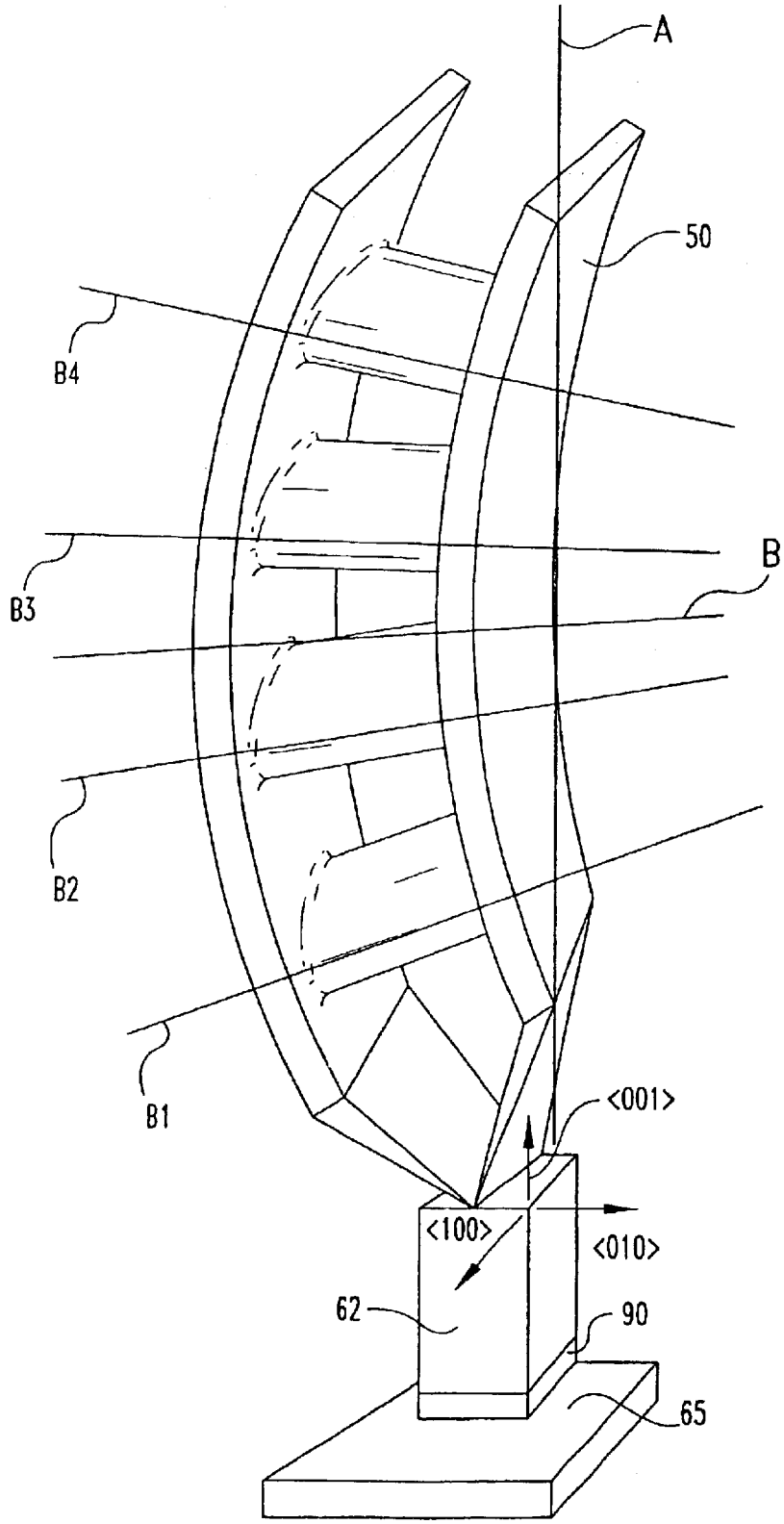
FIG. 5 is an illustrative view of a multi-airfoil vane segment formed from the casting mold of FIG. 4.

With reference to FIG. 4, there is illustrated a casting mold 200 with a molten metal receiving cavity for receiving molten metal therein and forming the multi-airfoil vane segment. Referring to FIG. 5, there is illustrated the multi-airfoil vane segment 50 and metallic starter seed 62 with the walls of a casting mold 200 removed to aid the reader. A portion of the metallic starter seed 62 extends into the molten metal receiving cavity of the mold. The molten directionally solidified alloy contacts the starter seed 62 and causes the partial melt back thereof. In a preferred form of the process for producing the cast multi-airfoil vane segment the starter seed 62 is not in contact with a chill 65. More preferably an insulator 90 is disposed between the starter seed 62 and the chill 65. The insulator 90 functions to thermally insulate the starter seed 62 from the cooling chill 65 and thus promote melting of a portion of the starter seed.

The directionally solidified alloy is solidified by a thermal gradient moving vertically through the casting mold. More particularly, the directionally solidified alloy is solidified epitaxially from the unmelted portion of the starter seed 62 to form the single crystal product. In one form, the thermal gradient for solidifying the directionally solidified alloy is produced by a combination of mold heating and mold cooling. One system for effectuating the thermal gradient in the mold comprises a mold heater, a mold cooling cone, a chill and the withdrawal of the structure being cast. Further details related to the growing of single crystal alloy structures are believed known to those of ordinary skill in the art and therefore have not been provided. The cast single crystal alloy product has been described in terms of a vane segment, however other cast single crystal product configurations formed of a directionally solidified alloy, such as blades seals, shrouds, blade tracks, nozzle liners and other components subjected to high temperature and stress are contemplated herein.

In one form of the present invention the starter seed 62 is formed and/or oriented such that the seeds <001> (primary orientation) crystal direction is substantially parallel with a tangent A, and the seeds <010> (secondary orientation) crystal direction is substantially parallel with the average airfoil stacking axis B. The average airfoil stacking axis B is generally defined by the average of each airfoil stacking axis $B_1$, $B_2$, $B_3$, and $B_4$. The illustration of FIG. 5 is not intended herein to limit the solidification direction to that shown in the drawings. In an alternative embodiment the solidification direction is substantially parallel to the average airfoil stacking axis B. Further, other solidification directions are contemplated herein. The present invention is not limited to the use of a starter seed to impart the crystallographic structure to the crystal being grown Single crystals can be grown by techniques generally known to one of ordinary skill in the art, such as utilizing thermal nucleation and the selection of a grain for continued growth with a pigtail sorting structure.

In one form the cast single crystal vane segment can be used without the long homogenization heat treat cycles commonly used to maximize properties of cast single crystal articles. In another form of the present invention, which is well suited for articles such as gas turbine blades, the article can be used in a fully heat treated condition. The fully heat treated article maximizes stress rupture and minimizes the formation of deleterious topologically close packed (TCP) phases such as sigma upon the long term exposure of the article to high temperature and stress. The long term exposure will be greater than one thousand hours.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A gas turbine engine component comprising an integrally formed single cast single crystal shrouded vane formed of a directionally solidified alloy material; said shrouded vane including a pair of spaced apart endwalls and an axis tangent to one of said pair of endwalls, said single crystal having a primary crystal direction substantially parallel to said axis.

2. The component of claim 1, wherein said directionally solidified alloy material includes at least one grain boundary strengthener.

3. The component of claim 2, wherein said at least one grain boundary strengthener is selected from the group consisting of boron, carbon, hafnium and zirconium.

4. The component of claim 1, wherein said directionally solidified alloy material includes about 3 weight percent Rhenium.

5. The component of claim 1, wherein said vane includes an internal fluid flow passageway.

6. The component of claim 1, wherein said directionally solidified alloy material includes at least one grain boundary strengthener.

7. A vane segment comprising a cast metallic structure formed of a directionally solidified alloy material, said structure including a plurality of vanes integrally connecting and extending between a first endwall member and a second endwall member, at least one of said plurality of vanes having a stacking axis and said structure has an axis tangent to one of said endwall members, said structure is a single crystal having a primary crystal direction aligned with said tangent and a secondary crystal direction aligned with said stacking axis.

8. The vane segment of claim 7, wherein said directionally solidified alloy material includes about 3 weight percent Rhenium.

9. The vane segment of claim 7, said alloy consisting essentially of, in percentages by weight, 0.07 C, 6 Cr, 9 Co, 0.5 Mo, 8 W, 3 Ta, 3 Re, 5.7 Al, 0.7 Ti, 0.015 B, 0.005 Zr, 1.4 Hf, the balance being nickel and incidental impurities.

10. The vane segment of claim 7, said alloy consisting essentially of, in percentages by weight, 6.8 Cr, 12 Co, 2 Mo, 5 W, 6 Ta, 3 Re, 6.2 Al, 1.5 Hf, 0.12 C, 0.015 B, 0.02 Zr, the balance being nickel and incidental impurities.

11. The vane segment of claim 7, said alloy consisting essentially of, in percentages by weight, 6.5 Cr, 12 Co, 2 Mo, 6 W, 4 Ta, 3 Re, 1.5 Hf, 0.10 C, 0.015 B, 0.03 Zr, 6.0 Al, the balance being nickel and incidental impurities.

12. The vane segment of claim 7 wherein said alloy material is a second generation directionally solidified alloy material.

13. The vane segment of claim 7 wherein at least one of said plurality of vanes includes an internal fluid flow path.

14. The vane segment of claim 7, wherein each of said plurality of vanes includes an internal fluid flow path adapted for the passage of a cooling media.

15. A vane segment comprising a cast metallic structure formed of a directionally solidified alloy material, said structure including a plurality of vanes connecting between a first endwall member and a second endwall member, each of said plurality of vanes has a stacking axis and said structure has an axis tangent to one of said endwall members, said structure is a single crystal having a primary crystal direction substantially aligned with said axis tangent a secondary crystal direction substantially aligned with an average of said stacking axes.

16. The vane segment of claim 15, wherein said directionally solidified alloy material includes Rhenium.

17. The vane segment of claim 16, wherein said directionally solidified alloy material includes about 3 weight percent Rhenium.

18. The vane segment of claim 15, said alloy consisting essentially of, in percentages by weight, 0.07 C, 6 Cr, 9 Co, 0.5 Mo, 8 W, 3 Ta, 3 Re, 5.7 Al, 0.7 Ti, 0.015 B, 0.005 Zr, 1.4 Hf, the balance being nickel and incidental impurities.

19. The vane segment of claim 15, said alloy consisting essentially of, in percentages by weight, 6.8 Cr, 12 Co, 2 Mo, 5 W, 6 Ta, 3 Re, 6.2 Al, 1.5 Hf, 0.12 C, 0.015 B, 0.02 Zr, the balance being nickel and incidental impurities.

20. The vane segment of claim 15, said alloy consisting essentially of, in percentages by weight, 6.5 Cr, 12 Co, 2 Mo, 6 W, 4 Ta, 3 Re, 1.5 Hf, 0.10 C, 0.015 B, 0.03 Zr, 6.0 Al, the balance being nickel and incidental impurities.

21. The vane segment of claim 15 wherein at least one of said plurality of vanes includes an internal fluid flow path.

22. The vane segment of claim 15, each of said plurality of vanes includes an internal fluid flow path adapted for the passage of a cooling media.

23. A vane segment comprising a cast single crystal structure formed of a directionally solidified alloy material, said structure has a vane portion integrally connected between a first endwall member and a second endwall member, wherein said vane portion has a stacking axis and one of said endwall members has an axis tangent thereto, and said single crystal having a primary crystal direction aligned with said axis tangent and a secondary crystal direction aligned with said stacking axis.

24. The vane segment of claim 23, wherein said directionally solidified alloy material includes said Rhenium.

25. The vane segment of claim 24, wherein said directionally solidified alloy material includes about 3 weight percent Rhenium.

26. The vane segment of claim 23, said alloy consisting essentially of, in percentages by weight, 0.07 C, 6 Cr, 9 Co, 0.5 Mo, 8 W, 3 Ta, 3 Re, 5.7 Al, 0.7 Ti, 0.015 B, 0.005 Zr, 1.4 Hf, the balance being nickel and incidental impurities.

27. The vane segment of claim 23, said alloy consisting essentially of, in percentages by weight, 6.8 Cr, 12 Co, 2 Mo, 5 W, 6 Ta, 3 Re, 6.2 Al, 1.5 Hf, 0.12 C, 0.015 B, 0.02 Zr, the balance being nickel and incidental impurities.

28. The vane segment of claim 23, said alloy consisting essentially of, in percentages by weight, 6.5 Cr, 12 Go, 2 Mo, 6 W, 4 Ta, 3 Re, 1.5 Hf, 0.10 C, 0.015 B, 0.03 Zr, 6.0 Al, the balance being nickel and incidental impurities.

29. The vane segment of claim 23, wherein said alloy is a second generation directionally solidified alloy material.

30. The vane segment of claim 23, wherein said vane portion includes an internal cooling path for the passage of a cooling fluid.

31. A gas turbine engine component, comprising an integrally cast single crystal vane segment including a plurality of vanes, each of said plurality of vanes including a leading edge and a trailing edge and a first end and a second end, said vane segment has a first endwall member integrally connected with each of said first ends and a second endwall member integrally connected with each of said second ends, said vane segment formed of a directionally solidified alloy material and wherein each of said plurality of vanes has a stacking axis and said vane segment has an axis tangent to one of said endwalls, said single crystal having a primary crystal direction aligned with said axes tangent and a secondary crystal direction aligned with the average of said stacking axis.

32. The component of claim 31, said alloy consisting essentially of, in percentages by weight, 0.07 C, 6 Cr, 9 Co, 0.5 Mo, 8 W, 3 Ta, 3 Re, 5.7 Al, 0.7 Ti, 0.015 B, 0.005 Zr, 1.4 Hf, the balance being nickel and incidental impurities.

33. The component of claim 31, said alloy consisting essentially of, in percentages by weight, 6.8 Cr, 12 Co, 2 Mo, 5 W, 6 Ta, 3 Re, 6.2 Al, 1.5 Hf, 0.12 C, 0.015 B, 0.02 Zr, the balance being nickel and incidental impurities.

34. The component of claim 31, said alloy consisting essentially of, in percentages by weight, 6.5 Cr, 12 Co, 2 Mo, 6 W, 4 Ta, 3 Re, 1.5 Hf, 0.10 C, 0.015 B, 0.03 Zr, 6.0 Al, the balance being nickel and incidental impurities.

35. The component of claim 31, wherein at least one of said plurality of vanes has an internal cooling passageway for the passage of a cooling media.

36. The component of claim 31, wherein said directionally solidified alloy material includes at least one grain boundary strengthener.

* * * * *

UNITED STATES PATENT AND TRADEMARK OFFICE

CERTIFICATE OF CORRECTION

PATENT NO. : 6,800,148 B2
DATED : October 5, 2004
INVENTOR(S) : Donald J. Frasier et al.

It is certified that error appears in the above-identified patent and that said Letters Patent is hereby corrected as shown below:

Column 6,
Line 56, please insert -- axis -- after “said”.

Column 7,
Line 22, please insert -- and -- after “tangent”.
Line 44, please insert -- wherein -- after “claim 15,”.

Column 8,
Line 2, please delete “said”.
Line 14, please change “Go” to -- Co --.
Line 34, please change “axes” to -- axis --.
Line 36, please change “axis” to -- axes --.

Signed and Sealed this

Fifteenth Day of March, 2005

JON W. DUDAS
*Director of the United States Patent and Trademark Office*